US011077385B2

(12) United States Patent
Kogure

(10) Patent No.: US 11,077,385 B2
(45) Date of Patent: Aug. 3, 2021

(54) MAGNETIC PLATE TOY

(71) Applicant: People Co., Ltd., Tokyo (JP)

(72) Inventor: Masako Kogure, Tokyo (JP)

( * ) Notice: Subject to any disclaimer, the term of this patent is extended or adjusted under 35 U.S.C. 154(b) by 147 days.

(21) Appl. No.: 16/481,491

(22) PCT Filed: Jul. 13, 2018

(86) PCT No.: PCT/JP2018/026568
§ 371 (c)(1),
(2) Date: Jul. 29, 2019

(87) PCT Pub. No.: WO2019/150598
PCT Pub. Date: Aug. 8, 2019

(65) Prior Publication Data

US 2020/0353375 A1 Nov. 12, 2020

(30) Foreign Application Priority Data

Feb. 2, 2018 (JP) ..... JP2018-017469

(51) Int. Cl.
*A63H 33/26* (2006.01)
*A63H 33/04* (2006.01)
*A63H 33/10* (2006.01)

(52) U.S. Cl.
CPC ..... *A63H 33/046* (2013.01); *A63H 33/10* (2013.01); *A63H 33/26* (2013.01)

(58) Field of Classification Search
CPC ..... A63H 33/26
See application file for complete search history.

(56) References Cited

U.S. PATENT DOCUMENTS 3,982,334 A * 9/1976 Tate ..... A63H 33/26 434/409
5,347,253 A * 9/1994 Ogikubo ..... A63F 9/12 273/239

(Continued)

FOREIGN PATENT DOCUMENTS

JP S50-028876 8/1975
JP H8-257252 10/1996

(Continued)

OTHER PUBLICATIONS

International Search Report dated Oct. 16, 2018 for PCT/JP2018/026568.

(Continued)

*Primary Examiner* — John A Ricci
(74) *Attorney, Agent, or Firm* — Soei Patent & Law Firm

(57) ABSTRACT

A magnetic plate toy includes a plurality of magnets and a polygonal plate member that includes a plurality of accommodation onions. A first magnet is movable along a side wall of the plate member and is rotatable about a first rotation axis oriented along the length of the first magnet and about a second rotation axis oriented along a thickness direction of the plate member. The plurality of accommodation portions are disposed along one or more side walls of the plate member, and a first accommodation portion include a first end portion. A width of the first end portion is equal to or greater than the width of the first magnet, the width of the first end portion is less than the length of the first magnet, and a width of an accommodation space in the first accommodation portion is greater than the width of the first end portion.

20 Claims, 5 Drawing Sheets

(56) References Cited

U.S. PATENT DOCUMENTS

| | | | | |
|---|---|---|---|---|
| 5,746,638 | A | 5/1998 | Shiraishi | |
| 8,444,449 | B2 * | 5/2013 | Bowes | A63F 7/0088 446/129 |
| 2009/0170396 | A1 * | 7/2009 | Tardif | A63H 33/26 446/92 |
| 2010/0087119 | A1 | 4/2010 | Vicentelli | |
| 2010/0120322 | A1 | 5/2010 | Vicentelli | |
| 2012/0270465 | A1 | 10/2012 | Park | |

FOREIGN PATENT DOCUMENTS

| | | |
|---|---|---|
| JP | 3161698 | 8/2010 |
| JP | 2013-514128 | 4/2013 |
| JP | 2016-214533 | 12/2016 |
| WO | 2006/095939 | 9/2006 |

OTHER PUBLICATIONS

International Preliminary Report on Patentability with Written Opinion dated Aug. 13, 2020 for PCT/JP2018/026568.

* cited by examiner

MAGNETIC PLATE TOY

CROSS-REFERENCE TO RELATED APPLICATIONS

This application is a U.S. National Phase patent application of PCT Application No. PCT/JP2018/026568, filed Jul. 13, 2018, which claims the benefit of priority from Japanese Patent Application No. P2018-017469, filed Feb. 2, 2018.

TECHNICAL FIELD

An aspect of the invention relates to a magnetic plate toy.

BACKGROUND ART

Conventionally, a magnetic plate toy which is magnetically connected to a connection object is known as an intellectual toy (for example, see Patent Literature 1). The magnetic plate toy described in Patent Literature 1 includes polygonal plate members. A magnet is provided inside the plate member along a side portion of the plate member. The plate member is magnetically connected to another magnetic plate toy by using a magnetic force of the magnet. According to such a magnetic plate toy, it is intended to raise children's creativity and imagination through play.

CITATION LIST

Patent Literature

Patent Literature 1: Japanese Utility Model Registration No. 3161698

SUMMARY OF INVENTION

Technical Problem

In the above-described magnetic plate toy, another magnetic plate toy can be connected only to the side portion of the plate member where the magnet is disposed. For this reason, various connection methods are required.

Therefore, an aspect of the invention provides a magnetic plate toy that enables various connection methods.

Solution to Problem

A magnetic plate toy according to an aspect of the invention includes a plurality of first magnets and a polygonal plate member. Each of the plurality of first magnets has a pillar shape and a magnetization direction orthogonal to an axial direction. The plate member includes a plurality of first accommodation portions respectively accommodating the plurality of first magnets. The plurality of first magnets are accommodated in the first accommodation portions so as to be movable along a side portion of the plate member and rotatable about a rotation axis along the axial direction and a rotation axis along a thickness direction of the plate member. The plurality of first accommodation portions are disposed along the side portion of the plate member so as to be separated from each other. The plurality of first accommodation portions include one end portion and the other end portion in a direction along the side portion. When viewed from the thickness direction, a length of the one end portion is equal to or longer than a length of the first magnet in a direction orthogonal to the axial direction and is shorter than a length of the first magnet in the axial direction.

In the magnetic plate toy, the first magnet is accommodated in the first accommodation portion of the plate member so as to be movable along the side portion of the plate member. For this reason, the magnetic plate toy can be connected to another magnetic plate toy in a wide range of the side portion. The first accommodation portion includes one end portion in the direction along the side portion. When viewed from the thickness direction of the plate member, the length of one end portion is equal to or longer than the length of the first magnet in the direction orthogonal to the axial direction and is shorter than the length of the first magnet in the axial direction. For this reason, all of the pair of end portions in the axial direction of the first magnet can be disposed in one end portion of the first accommodation portion. However, all of the pair of end portions in the direction orthogonal to the axial direction of the first magnet cannot be disposed in one end portion of the first accommodation portion. A magnetic force of the end portion in the axial direction of the first magnet is weaker than that of the end portion in the direction orthogonal to the axial direction of the first magnet. Thus, even when all end portions in the axial direction of the first magnet are disposed in one end portion of the first accommodation portion, a connection with the first magnet at the adjacent first accommodation portions is not easy. Accordingly, it is possible to widen a range in which the first magnet is movable along the side portion while preventing the connection of the first magnets between the adjacent first accommodation portions. The first magnet is accommodated in the first accommodation portion so as to be rotatable about not only the rotation axis along the axial direction but also the rotation axis along the thickness direction of the plate member. For this reason, the magnetic plate toy can be connected to another magnetic plate toy also in a portion other than the side portion of the plate member. With the above-described configuration, various connection methods can be enabled.

In the magnetic plate toy, when viewed from the thickness direction, a length of the other end portion may be equal to or longer than the length of the first magnet in a direction orthogonal to the axial direction and may be shorter than the length of the first magnet in the axial direction. In this case, all of the pair of end portions of the first magnet in the axial direction can be disposed at the other end portion of the first accommodation portion. However, all of the pair of end portions in a direction orthogonal to the axial direction of the first magnet cannot be disposed at the other end portion of the first accommodation portion. Accordingly, it is possible to further widen a range in which the first magnet is movable along the side portion while preventing the connection of the first magnets between the adjacent first accommodation portions.

In the magnetic plate toy, the first magnet may have a quadrangular pillar shape. In this case, the first magnet is connected to another magnetic plate toy at a planar side surface portion. For this reason, it is possible to improve a connection force as compared with a case in which the first magnet has a columnar shape and is connected to another magnetic plate toy at a curved side surface portion.

The magnetic plate toy may further include a second magnet and the plate member may further include a second accommodation portion which is disposed so as to be separated from the side portion and the plurality of first accommodation portions. The second magnet may be accommodated in the second accommodation portion so as to be movable in a direction orthogonal to the thickness direction. In this case, the second magnet is accommodated in the second accommodation portion. Thus, various connection methods can be further enabled.

Advantageous Effects of Invention

According to an aspect of the invention, it is possible to provide the magnetic plate toy that enables various connection methods.

DESCRIPTION OF EMBODIMENTS

Figure 1:
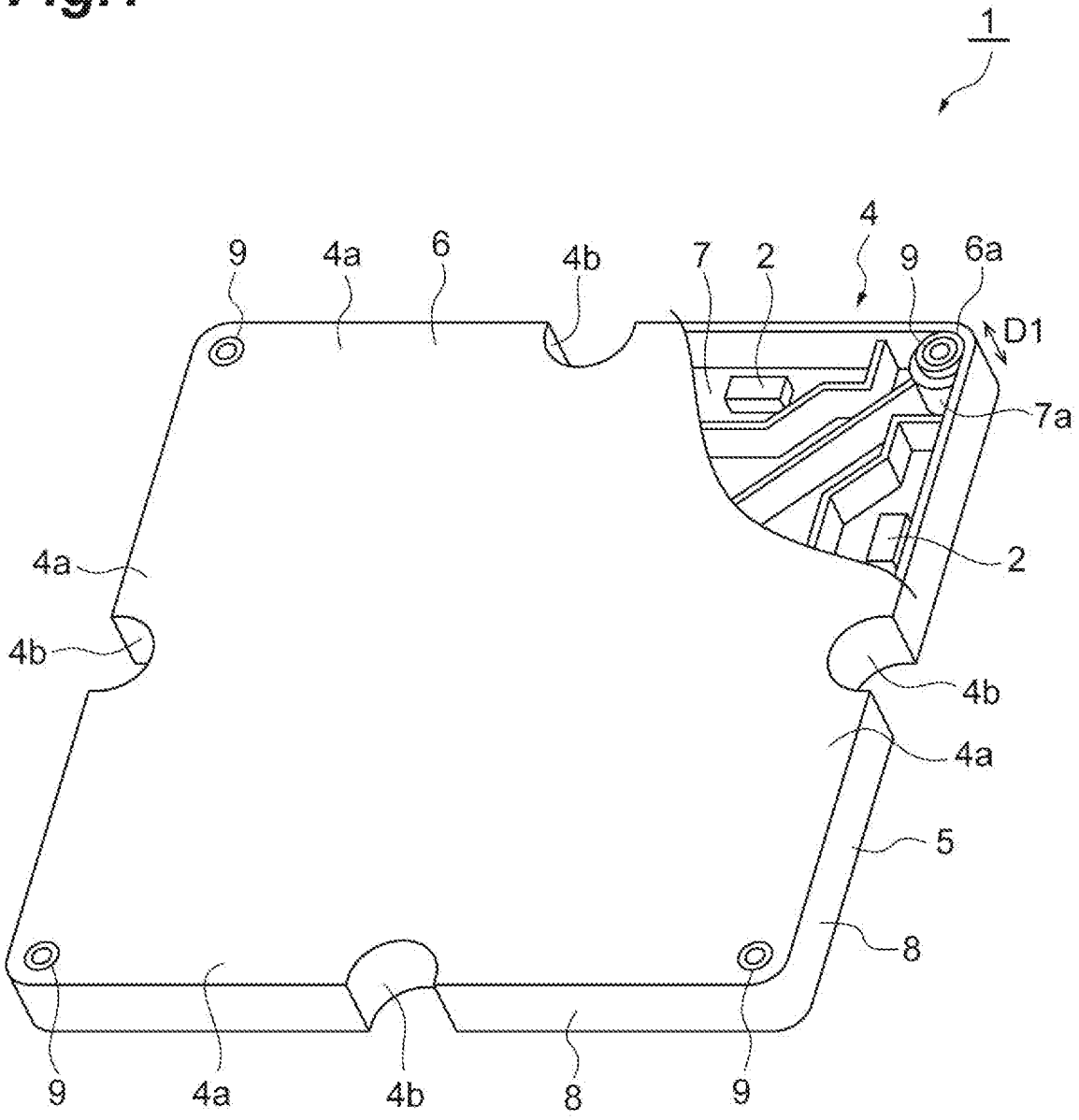
FIG. 1 is a partially broken perspective view of a magnetic plate toy according to an embodiment.

Hereinafter, an embodiment will be described in detail with reference to the accompanying drawings. Furthermore, in the description below, the same or equivalent components will be indicated by the same reference numerals and a repetitive description thereof will be omitted.

Figure 2:
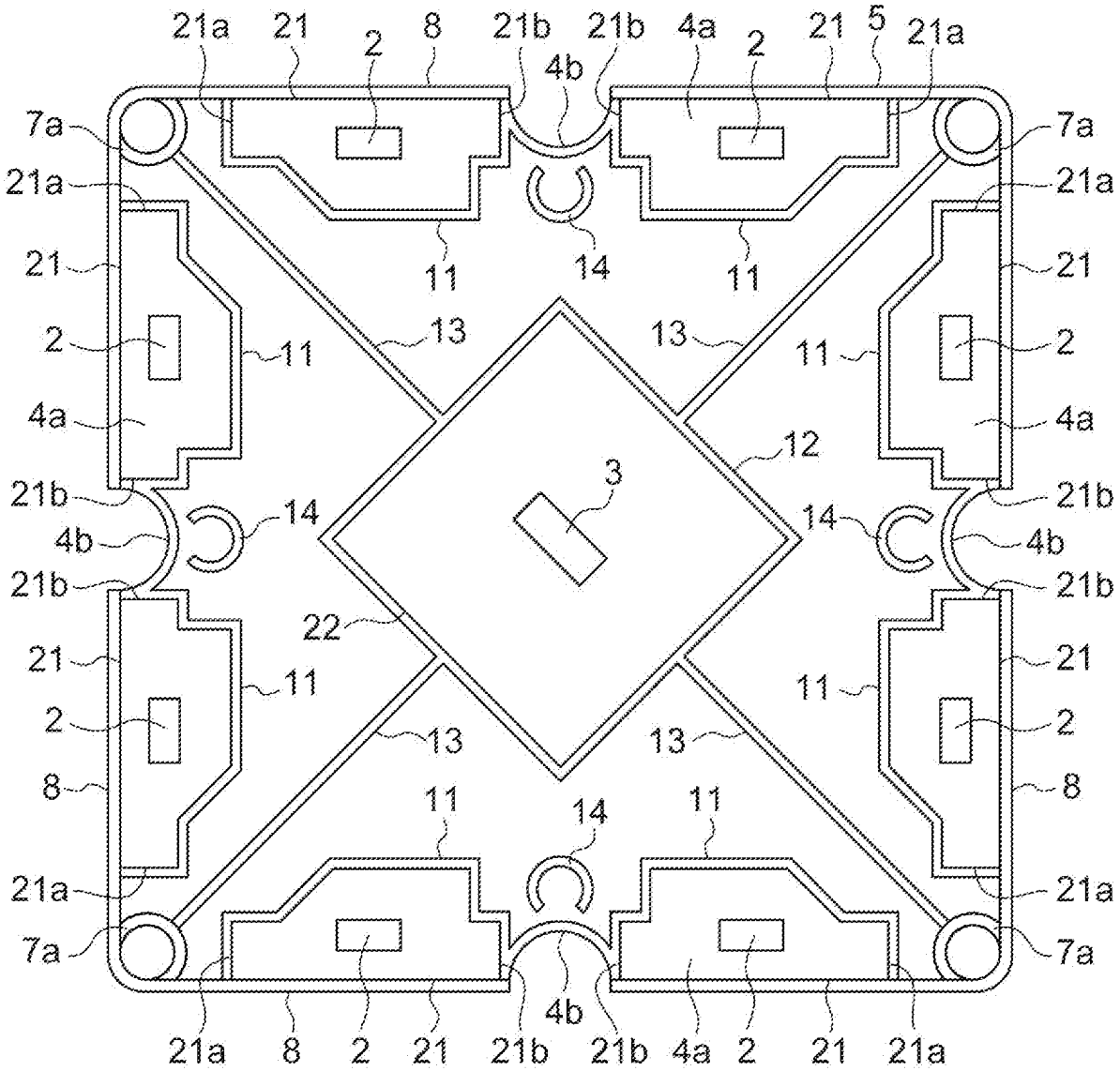
FIG. 2 is a top view of the magnetic plate toy of FIG. 1 with an upper wall removed.

FIG. 1 is a partially broken perspective view of a magnetic plate toy according to an embodiment. A magnetic plate toy 1 illustrated in FIG. 1 is an intellectual toy for raising children's creativity and imagination through play. FIG. 2 is a top view of the magnetic plate toy of FIG. 1 with an upper wall removed. As illustrated in FIGS. 1 and 2, the magnetic plate toy 1 includes a plurality of (here, eight) first magnets 2, a second magnet 3, and a plate member 4.

The first magnet 2 and the second magnet 3 have a pillar shape. As an example, the first magnet 2 and the second magnet 3 have a quadrangular pillar shape of which a bottom surface is a quadrangle, in particular, a square pillar shape of which a bottom surface is a square. The first magnet 2 and the second magnet 3 are formed of, for example, the same material. The first magnet 2 and the second magnet 3 are, for example, neodymium magnets. The first magnet 2 and the second magnet 3 have magnetization directions orthogonal to the axial direction. That is, the first magnet 2 and the second magnet 3 are divided into two parts in a direction orthogonal to the axial direction. The first magnet 2 has an N pole portion which is disposed at one side in a direction orthogonal to the axial direction and an S pole which is disposed at the other side in a direction orthogonal to the axial direction. The dimension (volume) and the magnetic force of the second magnet 3 are larger than, for example, the dimension and the magnetic force of the first magnet 2. The schematic outer dimension of the first magnet 2 is, for example, 3 mm×3 mm×6 mm. The schematic outer dimension of the second magnet 3 is, for example, 3 mm×3 mm×8 mm.

The plate member 4 is a plate-shaped member having a uniform thickness. The plate member 4 has, for example, a polygonal shape such as a triangular shape and a rectangular shape when viewed from a thickness direction D1 of the plate member 4. As an example, the plate member 4 has a rectangular shape, particularly, a square shape, when viewed from the thickness direction D1. The plate member 4 includes a plurality of (here, four) side portions 4*a*. Each side portion 4*a* is provided with a groove 4*b* which extends in the thickness direction D1 and has a U-shaped cross-section. The groove 4*b* is provided in a center portion of the side portion 4*a* in the longitudinal direction. The groove 4*b* may not be provided.

Figure 3:
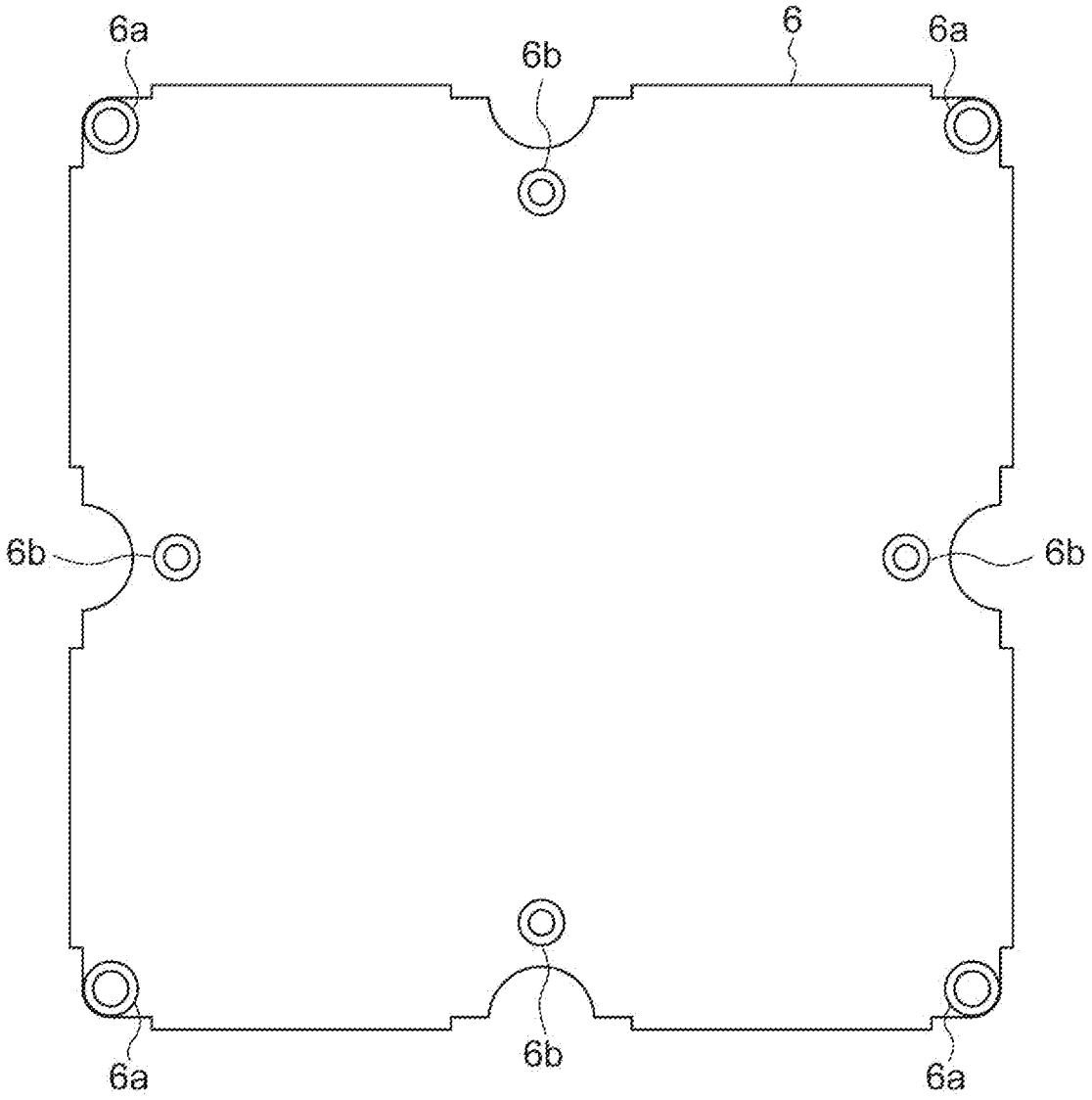
FIG. 3 is a bottom view of the upper wall of the magnetic plate toy of FIG. 1.

FIG. 3 is a bottom view of the upper wall of the magnetic plate toy of FIG. 1. As illustrated in FIGS. 1 to 3, the plate member 4 is hollow and includes a bottom member 5 and an upper wall 6. The bottom member 5 includes a bottom wall 7 which opposes the upper wall 6 and four side walls 8 which connect the upper wall 6 and the bottom wall 7. Each of the upper wall 6 and the bottom wall 7 has, for example, a square shape of which one side is 75 mm. Each of four side walls 8 has, for example, a rectangular shape of 75 mm×6.5 mm. That is, the thickness of the plate member 4 is, for example, 6.5 mm and the plate member 4 has a square shape of which one side is, for example, 75 mm when viewed from the thickness direction D1.

The plate member 4 is formed of, for example, plastic such as ABS resin (acrylonitrile-butadiene-styrene copolymer). Since the plate member 4 is formed of plastic, the plate member 4 can be easily manufactured by, for example, injection molding. For example, the interest of children can be increased by using plastic of various colors as the material of the plate member 4. Since transparent plastic is used as the material of the plate member 4, the inside of the assembled solid figure is visible. Accordingly, the interest of children can be further increased.

The plate member 4 is formed by covering the opening of the bottom member 5 by the upper wall 6. The bottom member 5 and the upper wall 6 are formed in such a manner that cylindrical portions 7*a* respectively provided at four corners of the bottom wall 7 are fitted to cylindrical portions 6*a* respectively provided at four corners of the upper wall 6. The cylindrical portion 6*a* is provided inside the cylindrical portion 7*a* and a metallic eyelet 9 is provided inside the cylindrical portion 6*a*. Accordingly, the bottom member 5 and the upper wall 6 are bonded to each other. The bottom member 5 and the upper wall 6 are also bonded to each other by high frequency welding or the like.

A plurality of ribs 11 to 13 are provided inside the bottom member 5. The plurality of ribs 11 to 13 are provided on the bottom wall 7. The plurality of ribs 11 to 13 extend along the thickness direction D1 of the plate member 4. The height of the plurality of ribs 11 to 13 (the length in the thickness direction D1) is the same as the gap between the upper wall 6 and the bottom wall 7. The front end portions of the plurality of ribs 11 to 13 are connected to the upper wall 6. The plurality of ribs 11 to 13 extend along the bottom wall 7. The rib 13 is provided inside the bottom member 5 in addition to the ribs 11 and 12. Accordingly, the strength of the plate member 4 is improved.

A plurality of substantially cylindrical portions 14 are provided on the bottom wall 7. The plurality of substantially cylindrical portions 14 are cylindrical members provided with slits extending in the axial direction. The plurality of substantially cylindrical portions 14 have a C-shaped cross-section. The plurality of substantially cylindrical portions 14 are disposed so that the slits oppose the groove 4*b*. The plurality of substantially cylindrical portions 14 are fitted to a plurality of cylindrical portion 6*b* provided in the upper wall 6. The substantially cylindrical portion 14 is disposed at the outside and the cylindrical portion 6*b* is disposed at the inside. The substantially cylindrical portion 14 and the cylindrical portion 6*b* serve as guides which facilitate the assembly of the bottom member 5 and the upper wall 6. The strength of the plate member 4 is further improved by the substantially cylindrical portion 14 and the cylindrical portion 6*b*.

The plate member 4 includes a plurality of (here, eight) first accommodation portions 21 and a second accommodation portion 22. The plurality of first accommodation portions 21 respectively accommodate the plurality of first magnets 2. The plurality of first accommodation portions 21 are defined by the rib 11, the upper wall 6, the bottom wall 7, and the side wall 8. The plurality of first accommodation portions 21 are disposed along the side portion 4*a* of the plate member 4 so as to be separated from each other. A pair of the first accommodation portions 21 are disposed along each side portion 4*a*. The first accommodation portion 21 includes an end portion 21*a* and an end portion 21*b* in a direction along the side portion 4*a*.

The plurality of first accommodation portions 21 are disposed so that the end portions 21*a* or the end portions 21*b* of the pair of adjacent first accommodation portions 21 are adjacent to each other. In the pair of first accommodation portions 21 disposed along each side portion 4*a*, the end portions 21*b* oppose each other with the groove 4*b* interposed therebetween.

Figure 4:
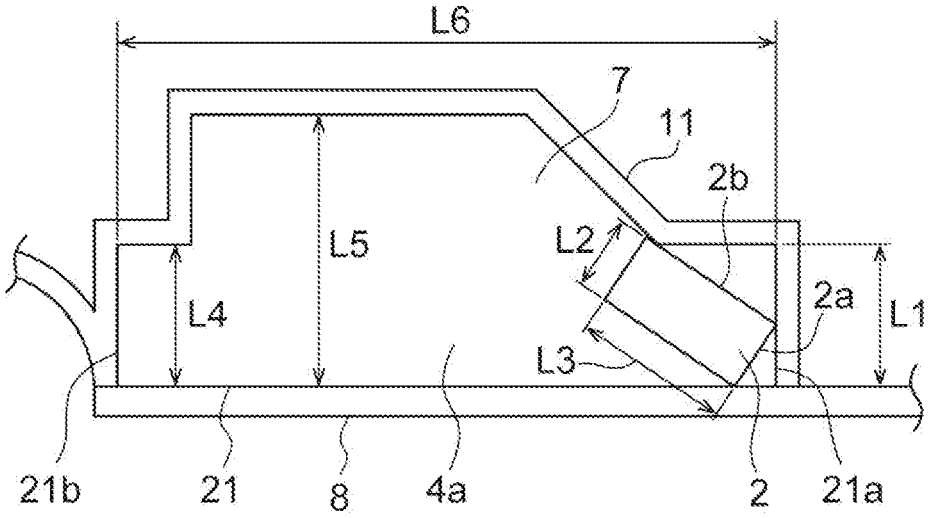
FIG. 4 is a partially enlarged view of FIG. 2.

FIG. 4 is a partially enlarged view of FIG. 2. As illustrated in FIG. 4, when viewed from the thickness direction D1 (see FIG. 1), a length L1 of the end portion 21*a* is equal to or longer than a length L2 of the first magnet 2 in a direction orthogonal to the axial direction and is shorter than a length L3 of the first magnet 2 in the axial direction. When viewed from the thickness direction D1, a length L4 of the end portion 21*b* is equal to or longer than the length L2 and is shorter than the length L3. For example, the length L1 is equal to the length L4.

A length L5 of the first accommodation portion 21 in a direction orthogonal to the side portion 4*a* (the side portion 4*a* provided with the first accommodation portion 21) is longer than the length L3. For example, a length L6 of the first accommodation portion 21 in a direction along the side portion 4*a* is longer than three times the length L3, longer than ¼ the length of the side portion 4*a*, and shorter than ⅓ the length of the side portion 4*a*. The length L1 is, for example, 5 mm. As described above, the length L2 is, for example, 3 mm and the length L3 is, for example, 6 mm. The length L1 is, for example, 5 mm. The length L5 is, for example, 9 mm. The length L6 is, for example, 22 mm.

The length of the first accommodation portion 21 in the thickness direction D1 (the gap between the upper wall 6 and the bottom wall 7) is shorter than the length L3. Thus, in the first accommodation portion 21, the axial direction of the first magnet 2 is orthogonal to the thickness direction D1 and does not coincide with the thickness direction D1. The length of the first accommodation portion 21 in the thickness direction D1 is, for example, 4.8 mm.

The plurality of first magnets 2 are accommodated in the first accommodation portion 21 so as to be movable along each side portion 4*a* of the plate member 4 and rotatable about the rotation axis along the axial direction and the rotation axis along the thickness direction D1. In other words, the first accommodation portion 21 is set to a size in which the first magnet 2 is rotatable about the rotation axes along the axial direction and the thickness direction D1.

As illustrated in FIG. 2, the second accommodation portion 22 accommodates the second magnet 3. The second accommodation portion 22 is defined by the rib 12, the upper wall 6 (see FIG. 1), and the bottom wall 7. The second accommodation portion 22 is disposed so as to be separated from the side portion 4*a* and the plurality of first accommodation portions 21. The second accommodation portion 22 has a square shape of which one side is, for example, 26 mm when viewed from the thickness direction D1 (see FIG. 1) and is disposed at a center portion of the plate member 4. Each corner portion of the second accommodation portion 22 opposes the center portion of each side portion 4*a* of the plate member 4 (see FIG. 1). Each corner portion of the second accommodation portion 22 opposes the groove 4*b* with the substantially cylindrical portion 14 interposed therebetween. Each side portion of the second accommodation portion 22 is connected to the cylindrical portion 7*a* by the rib 13. The second magnet 3 is accommodated in the second accommodation portion 22 so as to be movable in a direction orthogonal to the thickness direction D1.

The length of the second accommodation portion 22 in the thickness direction D1 (the gap between the upper wall 6 and the bottom wall 7) is shorter than the length of the second magnet 3 in the axial direction. Thus, in the second accommodation portion 22, the axial direction of the second magnet 3 is orthogonal to the thickness direction D1 and does not coincide with the thickness direction D1. The length of the second accommodation portion 22 in the thickness direction D1 is equal to, for example, the length of the first accommodation portion 21 in the thickness direction D1. The length of the second accommodation portion 22 in the thickness direction D1 is, for example, 4.8 mm.

The second magnet 3 is accommodated in the second accommodation portion 22 so as to be rotatable about the rotation axis along the axial direction and the rotation axis along the thickness direction D1. In other words, the second accommodation portion 22 is set to a size in which the second magnet 3 is rotatable about the rotation axes along the axial direction and the thickness direction D1.

In the magnetic plate toy 1 with the above-described configuration, the first magnet 2 is accommodated in the first accommodation portion 21 so as to be movable along the side portion 4*a* of the plate member 4. For this reason, the magnetic plate toy 1 can be connected to another magnetic plate toy in a wide range of the side portion 4*a*. In a state in which another magnetic plate toy is connected to the side portion 4*a* of the magnetic plate toy 1, another magnetic plate toy can be moved (slid) along the side portion 4*a*. Another magnetic plate toy may have the same configuration as that of the magnetic plate toy 1 or may have a configuration different from that of the magnetic plate toy 1. As an example, another magnetic plate toy has the same configuration as that of the magnetic plate toy 1.

When viewed from the thickness direction D1, the length L1 is equal to or longer than the length L2 and is shorter than the length L3. For this reason, all of the pair of the end portions 2*a* (the bottom surface portion of the first magnet 2) of the first magnet 2 in the axial direction can be disposed at the end portion 21*a* of the first accommodation portion 21. However, all of the pair of the end portions 2*b* (the side surface portion of the first magnet 2) in a direction orthogonal to the axial direction of the first magnet 2 cannot be disposed at the end portion 21*a* of the first accommodation portion 21. The magnetic force of the end portion 2*a* is weaker than that of the end portion 2*b*. Thus, even when the entire end portion 2*a* is disposed at the end portion 21*a* of the first accommodation portion 21, the first magnet 2 is not easily connected to the first magnet 2 at the adjacent first accommodation portion 21. Accordingly, it is possible to widen a range in which the first magnet 2 is movable along the side portion 4*a* while preventing the connection of the first magnets 2 in the adjacent first accommodation portions 21.

The first magnet 2 is accommodated in the first accommodation portion 21 so as to be rotatable about not only the rotation axis along the axial direction but also the rotation axis along the thickness direction D1. For this reason, the magnetic plate toy 1 can be connected to another magnetic plate toy also in a portion other than the side portion 4*a* of the plate member 4. As described above, according to the magnetic plate toy 1, various connection methods with respect to another magnetic plate toy can be enabled.

In the magnetic plate toy 1, when viewed from the thickness direction D1, the length L4 of the end portion 21*b* is equal to the length L1 of the end portion 21*a*. That is, the length L4 is equal to or longer than the length L2 and is shorter than the length L3. For this reason, the entire end portion 2*a* can be disposed at the end portion 21*b* of the first accommodation portion 21. However, the entire end portion 2*b* cannot be disposed at the end portion 21*b* of the first accommodation portion 21. Accordingly, it is possible to further widen a range in which the first magnet 2 is movable along the side portion 4*a* while preventing the connection of the first magnets 2 in the adjacent first accommodation portions 21.

In the magnetic plate toy 1, the first magnet 2 has a quadrangular pillar shape. For this reason, the first magnet 2 is connected to another magnetic plate toy at a planar side surface portion, that is, the end portion 2*b*. Thus, it is possible to improve a connection force as compared with a case in which the first magnet 2 has a columnar shape and the first magnet is connected to another magnetic plate toy at a curved side surface portion.

In the magnetic plate toy 1, the second magnet 3 is accommodated in the second accommodation portion 22 so as to be movable in a direction orthogonal to the thickness direction D1. The second accommodation portion 22 is disposed so as to be separated from the side portion 4*a* and the plurality of first accommodation portions 21. For this reason, another magnetic plate toy can be connected to the magnetic plate toy 1 in a wide range of the upper wall 6 and the bottom wall 7 of the magnetic plate toy 1. Further, in a state in which another magnetic plate toy is connected to the upper wall 6 or the bottom wall 7 of the magnetic plate toy 1, another magnetic plate toy can be moved (slid) along the upper wall 6 or the bottom wall 7. At this time, the upper wall, the bottom wall or the side wall of another magnetic plate toy may be connected to the upper wall 6 and the bottom wall 7 of the magnetic plate toy 1.

The second magnet 3 is accommodated in the second accommodation portion 22 so as to be rotatable about not only the rotation axis along the axial direction but also the rotation axis along the thickness direction D1. Thus, for example, in a state in which the side portion of another magnetic plate toy is connected to the upper wall 6 or the bottom wall 7 of the magnetic plate toy 1, another magnetic plate toy can also be rotated. Thus, various connection methods can be further enabled.

Figure 5:
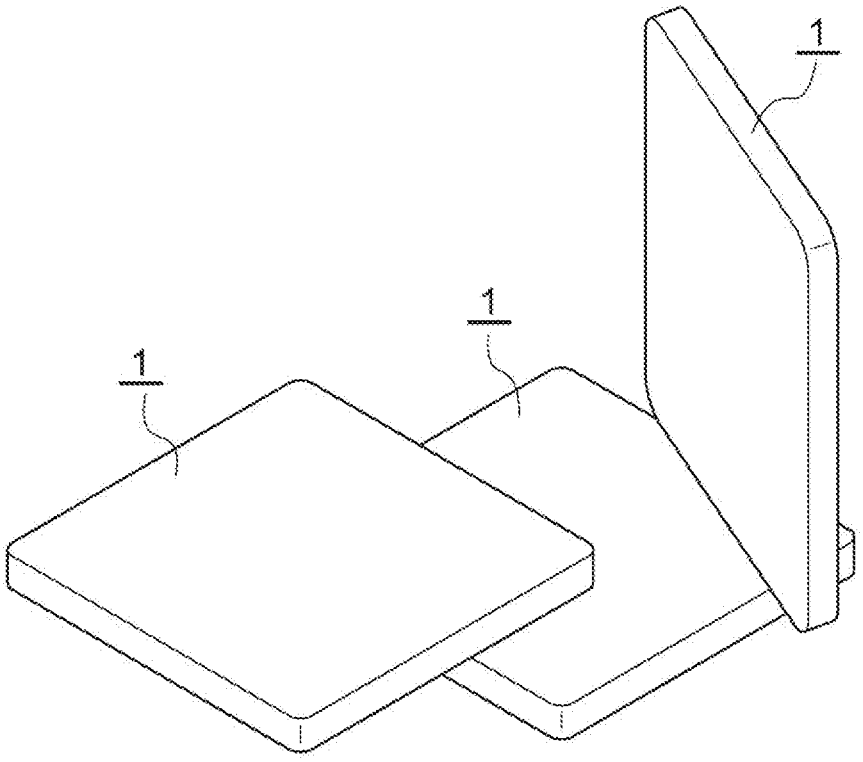
FIG. 5 is a perspective view describing a method of connecting the magnetic plate toys.

FIG. 5 is a perspective view describing a method of connecting the magnetic plate toys. The groove 4*b* is not illustrated in FIG. 5. As illustrated in FIG. 5, a plurality of (here, three) magnetic plate toys 1 are connected to each other. According to the magnetic plate toy 1, not only the side portion 4*a* but also an arbitrary position of the upper wall 6 and the bottom wall 7 can be connected to another magnetic plate toy 1.

In the magnetic plate toy 1, even when the magnet of another magnetic plate toy is fixed to a predetermined position of the plate member, the first magnet 2 or the second magnet 3 rotates in accordance with the direction of the magnet of another magnetic plate toy. Thus, the magnetic plate toy 1 can be connected to another magnetic plate toy without any repelling force.

Although the embodiment of the invention has been described, the invention is not limited to the above-described embodiment and may be modified in a range not departing from the spirit described in the claims or may be applied to another case.

The magnetic plate toy 1 may include at least two or more first magnets 2 and first accommodation portions 21. The magnetic plate toy 1 may not include the second accommodation portion 22. The number and the size of the first accommodation portion 21 and the second accommodation portion 22 can be appropriately adjusted in response to the shape of the plate member 4. Any one of at least the length L1 and the length L4 may be equal to or longer than the length L2 and shorter that the length L3. The other thereof may be shorter than the length L2, or may be equal to or longer than the length L3.

The first magnet 2 and the second magnet 3 may have a columnar shape or a triangular pillar shape. The first magnet 2 and the second magnet 3 may be formed of different materials. The dimension and the magnetic force of the first magnet 2 may be the same as the dimension and the magnetic force of the second magnet 3. The dimension and the magnetic force of the first magnet 2 may be larger than the dimension and the magnetic force of the second magnet 3. The second magnet 3 may not have a pillar shape. The second magnet 3 may have, for example, a disk shape. The magnetization direction of the second magnet 3 may be the same as the axial direction.

REFERENCE SIGNS LIST

1: magnetic plate toy, 2: first magnet, 3: second magnet, 4: plate member, 4*a*: side portion, 21: first accommodation portion, 21*a*: end portion, 21*b*: end portion, 22: second accommodation portion, D1: thickness direction.

The invention claimed is:

1. A magnetic plate toy comprising:

a plurality of magnets including a first magnet having a length and a width oriented orthogonal to the length; and a polygonal plate member that includes a plurality of accommodation portions respectively accommodating the plurality of magnets, wherein the first magnet is accommodated in a first accommodation portion so as to be movable along a side wall of the plate member and so as to be rotatable within an accommodation space in the first accommodation portion about a first rotation axis oriented along the length of the first magnet and about a second rotation axis oriented along a thickness direction of the plate member, wherein the plurality of accommodation portions are disposed along one or more side walls of the plate member so as to be separated from each other, and the first accommodation portion includes a first end portion and a second end portion opposite the first end portion in a direction orthogonal to the thickness direction of the plate member along the side wall, and wherein when viewed from above the plate member, a width of the first end portion in a direction orthogonal to the side wall is equal to or greater than the width of the first magnet, the width of the first end portion is less than the length of the first magnet, and a width of the accommodation space in the direction orthogonal to the side wall is greater than the width of the first end portion.

2. The magnetic plate toy according to claim 1, wherein when viewed from above the plate member, a width of the second end portion in the direction orthogonal to the side wall is equal to or greater than the width of the first magnet, and the width of the second end portion is less than the length of the first magnet.

3. The magnetic plate toy according to claim 2, wherein a length of the second end portion along the side wall in the direction orthogonal to the thickness direction of the plate member is less than a length of the first end portion along the side wall in the direction orthogonal to the thickness direction of the plate member.

4. The magnetic plate toy according to claim 1, wherein the first magnet has a quadrangular pillar shape.

5. The magnetic plate toy according to claim 1, further comprising:

a second magnet, separate from the plurality of magnets, wherein the plate member further includes a second accommodation portion which is disposed so as to be separated from the side walls of the plate member and the plurality of accommodation portions, and wherein the second magnet is accommodated in the second accommodation portion so as to be movable in one or more directions orthogonal to the thickness direction of the plate member.

6. The magnetic plate toy according to claim 5, wherein the second accommodation portion is centrally disposed in the plate member.

7. The magnetic plate toy according to claim 6, wherein the second accommodation portion comprises four side walls located around the second magnet, and wherein the four side walls are joined together by four corners, each of the four corners opposing a respective center portion of the side walls of the plate member.

8. The magnetic plate toy according to claim 5, wherein the second magnet is longer than the first magnet, and wherein the second magnet is configured to rotate within the second accommodation portion about an axis oriented along the thickness direction of the plate member.

9. The magnetic plate toy according to claim 1, wherein the plurality of magnets are pillar shaped, and wherein a plurality of flat surfaces extend the length of the first magnet.

10. The magnetic plate toy according to claim 9, wherein the first magnet is configured to rotate within the accommodation space of the first accommodation portion such that each of the plurality of flat surfaces intermittently contact the side wall of the plate member.

11. The magnetic plate toy according to claim 9, wherein the first magnet comprises two end surfaces, and wherein a magnetic force associated with the two end surfaces is weaker than a magnetic force associated with the plurality of flat surfaces.

12. The magnetic plate toy according to claim 9, wherein the plurality of flat surfaces comprises four flat surfaces that extend the length of the first magnet.

13. The magnetic plate toy according to claim 1, wherein the plurality of magnets comprises a pair of magnets including the first magnet, and wherein the pair of magnets are located in a pair of accommodation portions along the side wall of the plate member.

14. The magnetic plate toy according to claim 13, wherein the plurality of magnets comprises four pairs of magnets located in four pairs of accommodation portions along four side walls of the plate member.

15. The magnetic plate toy according to claim 1, wherein a length of the first accommodation portion along the side wall of the plate member between the first end portion and the second end portion is greater than the length of the first magnet.

16. The magnetic plate toy according to claim 15, wherein the length of the first accommodation portion is equal to or greater than three times the length of the first magnet.

17. The magnetic plate toy according to claim 15, wherein the width of the accommodation space in the direction orthogonal to the side wall is greater than the length of the first magnet.

18. The magnetic plate toy according to claim 1, wherein the first magnet is configured to rotate within the first accommodation portion by a magnetic force in response to the magnetic plate toy being located adjacent a second magnetic plate toy in order to align a magnetization direction of the first magnet with an adjacent magnet of the second magnetic plate toy.

19. The magnetic plate toy according to claim 18, wherein the magnetization direction is orthogonal to the length of the first magnet.

20. The magnetic plate toy according to claim 18, wherein the magnetization direction is orthogonal to the width of the first magnet.

* * * * *